US007592922B2

(12) United States Patent
La Vigne

(10) Patent No.: US 7,592,922 B2
(45) Date of Patent: Sep. 22, 2009

(54) SMOKE DETECTOR GUARD CONCENTRATOR

(75) Inventor: Michael Edward La Vigne, San Francisco, CA (US)

(73) Assignee: Michael E. La Vigne, San Francisco, CA (US)

( * ) Notice: Subject to any disclaimer, the term of this patent is extended or adjusted under 35 U.S.C. 154(b) by 317 days.

(21) Appl. No.: 11/654,430

(22) Filed: Jan. 18, 2007

(65) Prior Publication Data

US 2008/0174443 A1 Jul. 24, 2008

(51) Int. Cl.
*G08B 17/10* (2006.01)

(52) U.S. Cl. ..... 340/628; 340/693.6

(58) Field of Classification Search ..... 340/628, 340/629, 693.5–693.12; 362/186
See application file for complete search history.

(56) References Cited

U.S. PATENT DOCUMENTS 3,916,209 A * 10/1975 Steele et al. ..... 340/630
4,257,039 A * 3/1981 Webb et al. ..... 340/629
4,269,510 A * 5/1981 Horvath et al. ..... 340/630
4,328,424 A * 5/1982 O'Connor ..... 340/629
4,439,683 A * 3/1984 Dobrzanski ..... 250/381
4,529,976 A * 7/1985 Jameson et al. ..... 340/628
4,914,425 A * 4/1990 Kaminaka et al. ..... 340/693.6
5,257,013 A * 10/1993 Lewkowicz ..... 340/693.6
5,339,072 A * 8/1994 Agata ..... 340/693.6
5,486,816 A * 1/1996 Ariga et al. ..... 340/630
5,546,074 A * 8/1996 Bernal et al. ..... 340/628
5,751,218 A * 5/1998 Winterble et al. ..... 340/693.6
5,926,098 A * 7/1999 Wiemeyer et al. ..... 340/693.6
6,756,905 B2 * 6/2004 Rattman et al. ..... 340/693.12
6,778,091 B2 * 8/2004 Qualey et al. ..... 340/628
7,204,534 B2 * 4/2007 Kelly ..... 294/19.1
7,248,173 B2 * 7/2007 Yamasaki et al. ..... 340/693.6

* cited by examiner

*Primary Examiner*—John A Tweel, Jr.

(57) ABSTRACT

A baffle system for concentrating smoke and/or other products of combustion within a smoke detector guard. The baffle consists of four or more equally spaced fins, plates or blades fabricated from an appropriate material (such as sheet metal), inserted within the smoke detector guard, between the inner wall of the smoke detector guard and the outer surface of the smoke detector cover or housing located within the guard. The fins of the concentrator are formed such that there is a gap of no more than one-eighth inch between the edge of the fin and the profile of the outer wall of the smoke detector. The baffle fins, plates or blades form narrowing chambers between the interior walls and bottom of the smoke detector guard and the exterior of the smoke detector cover or housing that direct and concentrate the atmosphere entering through openings in the smoke detector guard to openings in the smoke detector cover or housing, decreasing the response time of the assembly to products of combustion in the atmosphere.

1 Claim, 4 Drawing Sheets

SMOKE DETECTOR GUARD CONCENTRATOR

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable.

BACKGROUND OF THE INVENTION

Fire, and more often the smoke generated by the fire, cause loss of life in buildings each year.

Fire and smoke detection alarm devices have been created in order to provide early warning to alert building occupants to the presence of the fire and/or smoke, so that they may take appropriate action to protect themselves from the dangers of the fire and smoke, and take whatever fire suppression actions as may be appropriate.

In recognition of the life safety benefits of a fire and smoke detection system, the owners and/or operators of many private and public facilities and institutions such as hotels, motels, inns, public housing, schools, colleges, jails, prisons, youth authority confinement facilities, hospitals, mental health institutions, etc. install smoke detectors, either voluntarily or pursuant to governing regulations or requirements, either as stand-alone detectors, or as part of an electronically integrated fire alarm system.

Additionally, both owners and operators of such facilities and institutions, as well as fire regulation enforcement authorities, recognize that the life safety benefits from such smoke detectors and fire alarm systems can not be realized if the smoke detectors and/or fire alarm systems are not operating as designed. Therefore good practices of maintenance of such smoke detectors and fire alarm systems are instituted, often in response to codified regulations.

Part of a good practice or codified system of smoke detector and fire alarm maintenance often requires protection of the smoke detectors from damage that may impair their performance, be they stand-alone smoke detectors or part of an integrated fire alarm system. Most smoke detectors have covers made of plastic or other man-made materials that can be easily damaged or broken, compromising the functioning of the smoke detection elements inside the smoke detector. Necessity requires that these smoke detectors be protected in situations where prudence would indicate that they may be subject to damage and/or abuse.

The answer to the smoke detector protection issue is often a smoke detector guard or housing that covers and secures the smoke detector, but also allows for the movement of air through the guard and the smoke detector to allow the smoke detector to function properly. The owners and operators of these facilities, as well as code enforcement authorities, sometimes desire to have smoke detector guards or housings that are so designed and constructed such that the access to the smoke detector through the smoke detector guard openings is limited, and/or the ability for someone to injure themselves by using the smoke detector guard is lessened.

There are a variety of smoke detector guards manufactured to meet these needs. However, many fire regulation enforcement authorities require that smoke detector guards be listed for use as an assembly by Underwriter Laboratories, Inc. or similar approved testing entity for use with the particular smoke detector that it guards. Most, if not all, smoke detector guards specifically designed and constructed to prevent access to the smoke detector inside and to reduce the probability of successful suicide attempts using the smoke detector guard, also restrict the flow of air to the smoke detector inside them, and thereby reduce the performance of the smoke detector such that the smoke detector/smoke detector guard assembly does not pass Underwriter Laboratories, Inc. tests for smoke detector performance. Hence, there is a market absence of smoke detector guards that are both Underwriter Laboratories, Inc. listed for use with smoke detectors, and that also meet the anti-suicide prevention requirements of many jurisdictions.

BRIEF SUMMARY OF THE INVENTION

In order to address this market void in smoke detector guard products that can be used in situations where it is desired or required that stand-alone smoke detectors and/or smoke detection integrated fire alarm systems have smoke detectors that are housed in protective smoke detector guards that are also Underwriter Laboratories, Inc. or equivalently listed or approved for use as an assembly with the specific smoke detectors to be installed, and the smoke detector guard is so designed and constructed that it meets the other requirements of restricted smoke detector access and/or anti-suicide prevention, but the smoke detector guard construction also impairs the performance of the smoke detector/smoke detector guard assembly such that it does not pass the Underwriter Laboratories, Inc. listing testing procedures, the Smoke Detector Guard Concentrator device was invented.

The Smoke Detector Guard Concentrator device consists of a series of baffles that form narrowing chambers that are designed to concentrate the reduced air flow within the smoke detector guard, and direct it to the smoke detection elements within the smoke detector itself. By concentrating and directing the reduced air flow within the smoke detector guard, the device enhances the performance of the smoke detector guard/smoke detector assembly such that the assembly performs sufficiently to pass the Underwriter Laboratories, Inc. or equivalent testing requirements for listing.

Extensive testing with Chase Security Systems, Inc. smoke detector guard products has revealed that baffles of different shapes and sizes within a smoke detector guard improve the performance of the smoke detector/smoke detector guard assembly to varying degrees. However, in order to improve the performance of the smoke detector/smoke detector guard assembly sufficiently to pass the rigorous Underwriter Laboratories, Inc. listing testing procedures, the internal baffling must capture and redirect sufficient amounts of the smoke entering the guard. This is most efficiently done when the smoke detector guard has at least four equally spaced fins or blades that fit as tightly as is practicable to the inner wall of the smoke detector guard and ceiling, and are formed to a tolerance of no more than one-eighth inch (⅛") around the exterior profile of the smoke detector head, with the smoke detector head located as close to the center of the smoke detector guard as is practicable.

BRIEF DESCRIPTION OF THE SEVERAL VIEWS OF DRAWING

In FIG. 1, an isometric view of a Chase Security Systems, Inc. Model CSGP 884 SMOKE DETECTOR/STROBE/BELL GUARD (A) is shown fitted with a Smoke Detector Guard Compensator (B). The Smoke Detector Guard Compensator is shown in a bold outline within the Chase Security Systems, Inc. smoke detector guard. The top of the Chase Security Systems, Inc. smoke detector guard, with its mounting collar, are shown facing toward the viewer.

In FIG. 2, the Smoke Detector Guard Compensator (B) shown in FIG. 1 is shown in the same isometric view, but without the Chase Security Systems, Inc. smoke detector guard.

The Smoke Detector Guard Compensator can be formed in a variety of ways, as is best determined for manufacturing, shipping and installation. FIG. 3 illustrates one example. In this example, the Smoke Detector Guard Compensator can be formed from two straight pieces with slots at the center of each fin; [one piece (B1), with a slot half-way up the fin, and one companion piece (B2), with a slot half-way down the fin.].

FIG. 4 shows a plan view of the two pieces of the Smoke Detector Guard Compensator (B1 and B2), illustrated in FIG. 3, slipped one over the other to form an "X", and inserted into the smoke detector guard prior to installation. FIG. 4, shows a plan view, looking up, at a Chase Security Systems, Inc. Model 884 SMOKE DETECTOR/STROBE/BELL GUARD (A) with the perforated plate bottom of the Chase Security Systems, Inc. smoke detector guard removed, fitted with the Smoke Detector Guard Compensator (B) over a typical smoke detector head (C) for which the Chase Security Systems, Inc. smoke detector guard/compensator assembly has been Underwriter Laboratories, Inc. listed. The attachment details for the Chase Security Systems, Inc. smoke detector guard are not shown.

FIG. 5 illustrates another example of how the Smoke Detector Guard Compensator (B) can be formed. In this example, the compensator is constructed of two identical fins that are to be bent at the center, at approximately a right (90-degree) angle.

FIG. 6 illustrates a plan view of the bent compensator fins from the FIG. 5 illustration (B), inserted into a Chase Security Systems, Inc. Model CSGP 884 SMOKE DETECTOR/STROBE/BELL GUARD (A), that are installed over a smoke detector head (C) that has been Underwriter Laboratories, Inc. listed for use with the Chase Security Systems, Inc. smoke detector guard/compensator assembly. The plan view is from the bottom, looking up, with the perforated plate bottom of the Chase Security Systems, Inc. smoke detector guard removed so as to illustrate the compensator fin (B) orientation with a maximum gap between the two fin pieces of one-sixteenth of an inch (1/16"). The attachment details for the Chase Security Systems, Inc. smoke detector guard (A) are not shown.

DETAILED DESCRIPTION OF THE INVENTION

The Smoke Detector Guard Compensator consists of at least four (4) fins or blades of a baffle system that are equally spaced in a smoke detector guard to make a seal as close as is practicable between the smoke detector guard and the smoke detector head inside the guard. The fins or blades of the baffle system that concentrate the smoke within the smoke detector guard can be formed of various materials and in various ways, such as, but not limited to: formed to fit in the smoke detector guard as an independent part that is loose or secured to the guard, formed as an integral part of the guard, secured to the smoke detection head, or formed as an integral part of the smoke detection head itself.

It is critical to note that the shape of the Smoke Detector Guard Compensator is unique to each smoke detector guard and smoke detector head combination to be Underwriter Laboratories, Inc. listed, and this patent application is intended to cover all past, current and future variations of shapes, sizes and configurations of smoke detector guard/smoke detector head/Compensator fin assemblies, including Compensator materials, means and methods of Compensator manufacture and attachment, or lack thereof.

Given the variety of shapes, sizes, materials, means and methods of manufacture and attachment that could be employed to produce an effective Smoke Detector Guard Compensator baffle system, it would be a daunting and impractical task to produce drawings for all the various Smoke Guard Detector Compensator systems that could be produced and covered under this patent. Therefore, the drawings in this patent application are limited to illustrations of the Smoke Detector Guard Compensator in conjunction with a Chase Security Systems, Inc. Model CSGP 884 SMOKE DETECTOR/STROBE/ALARM GUARD, as a means to show at least one manufactured version. However, by limiting the illustrations in this patent application to this one smoke detector guard/compensator assembly, it is in no way intended to limit the scope of the applied-for patent to this one particular smoke detector guard/compensator.

Figure 1:
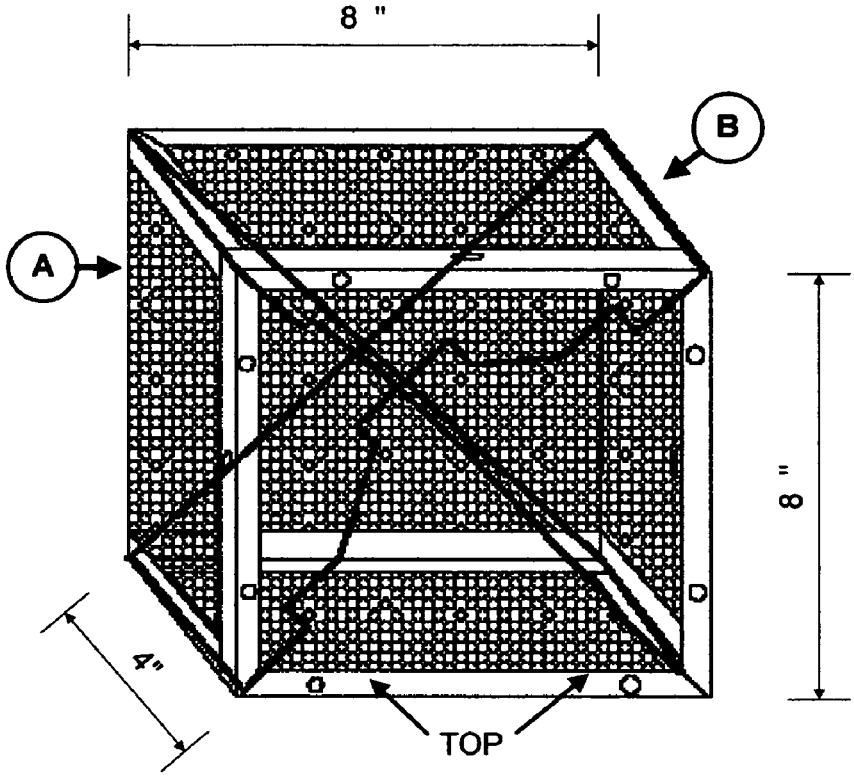

The fabrication process begins with determining, within construction tolerances, the inner dimensions of the smoke detector guard and the exact profile of the smoke detector head for which it is to be used. FIG. 1 shows how the Smoke Detection Guard Compensator for the Chase Security Systems, Inc. Model CSGP 884 SMOKE DETECTOR/STROBE/BELL GUARD will fit within the guard, which is a nominal 8-inch square, by 4-inch deep unit. The fins of the smoke detector guard compensator are inserted equal distances apart into the smoke detector guard as illustrated in FIG. 1.

Figure 2:
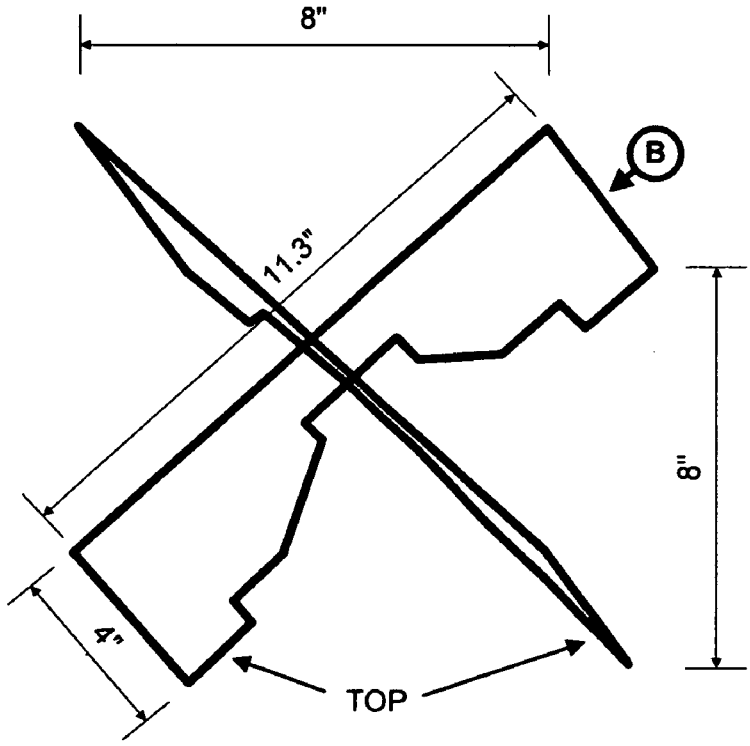

The Smoke Detector Guard Compensator shown in FIG. 2, is made from non-combustible rigid material such as medium gauge, painted, sheet metal (such as 16-26 gauge steel), and is fabricated for insertion into a smoke detector guard. The compensator baffle must be formed to consist of at least four (4) fins that fit snuggly together, fit snuggly against the smoke detector guard inner walls, and to a maximum of one-eighth inch (⅛") from the outer walls of the smoke detector head cover. This Smoke Detector Guard Compensator is fabricated from non-combustible rigid material, such as sheet metal of a sufficient gauge (e.g. 16-26 gauge steel) so that it will retain its shape during manufacture, shipping, and installation.

Manufacturing means and methods are always evolving, and differing manufacturing means and methods employed may involve different types and thicknesses of material for the Compensator fins. This is illustrated by FIGS. 3 through 6, that show two types of manufacturing configurations for compensator fin inserts.

Figure 3:
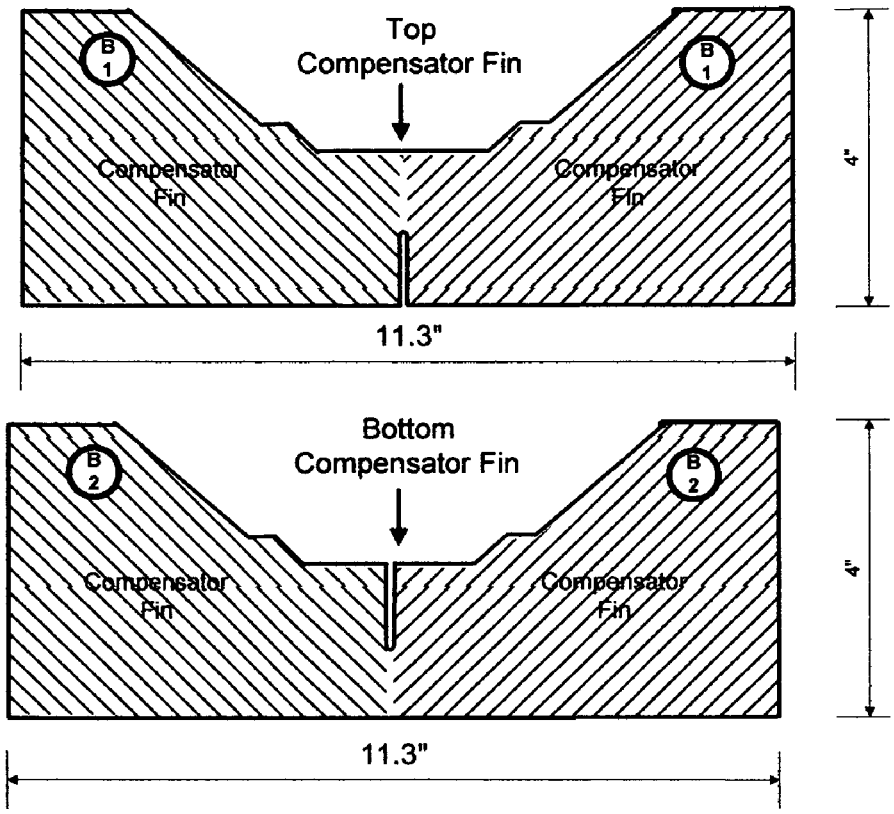
Figure 4:
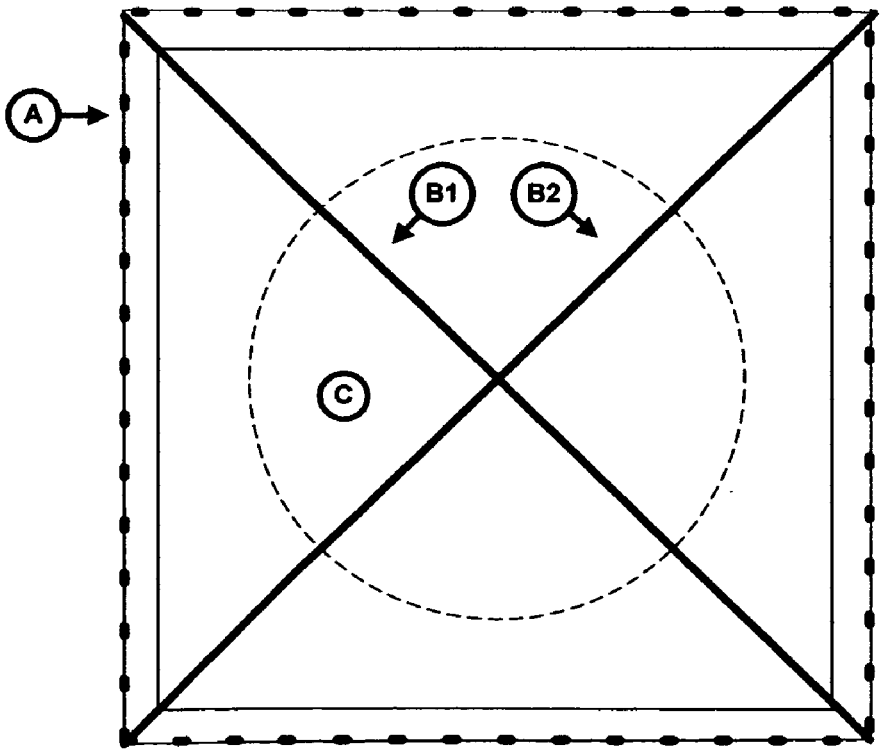

FIGS. 3 & 4 illustrate a method of manufacture that uses two separate pieces of material, formed from two straight pieces with slots at the center of each fin.

The depth or height of the slot shown in the fins in FIG. 3, (B1) and (B2), is to be slightly greater than half the height of the fin at its center (as determined by the profile of the smoke detector head to be used in conjunction with the smoke detector guard/compensator assembly) and slightly wider than the thickness of the material used to fabricate the Compensator fins, so that there is a snug fit of the two pieces when they are inserted one into the other at the slots, to form an "X" shape that is inserted into the smoke detector guard, as shown in plan view in FIG. 4.

Figure 5:
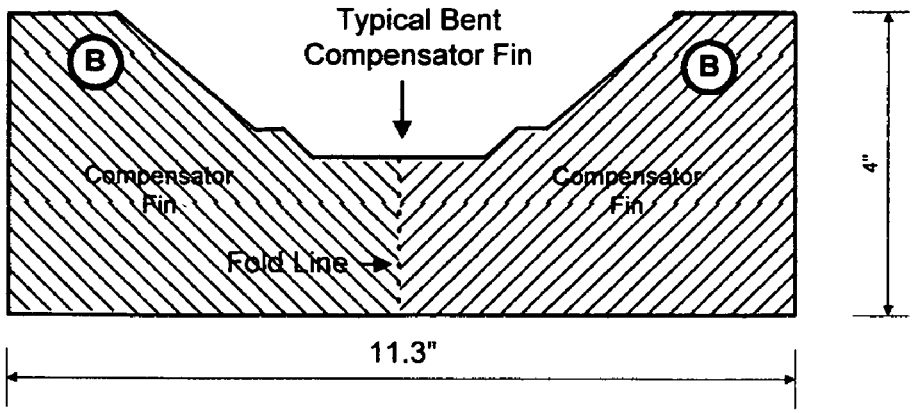
Figure 6:
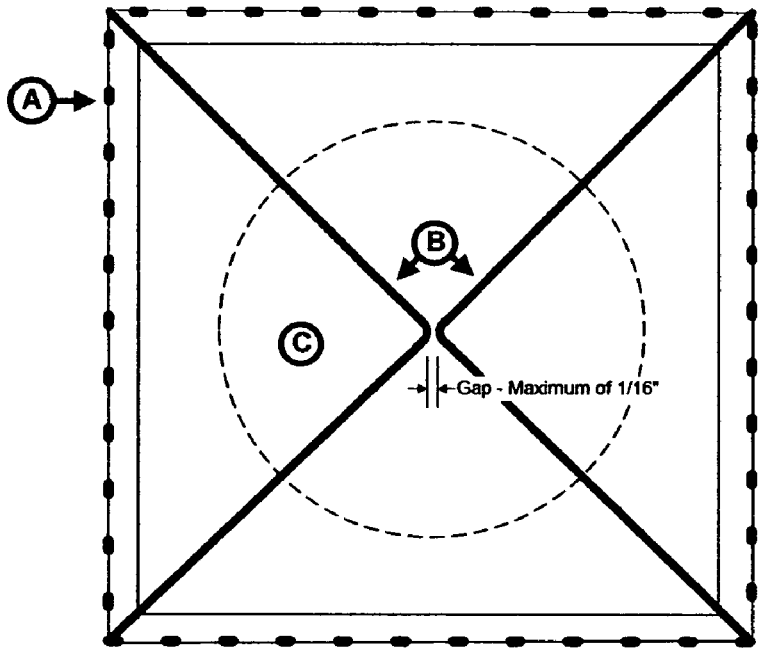

FIGS. 5 and 6 illustrate a method of manufacture that uses two identical pieces of material to form fins (B) that are bent in the center at a right angle (90-degrees) before being inserted into the smoke detector guard to form the "X" shape.

The fins shown in FIG. 5 (B) are bent, either prior to shipping, or by the installer, and the compensator (B) is inserted into the Chase Security Systems, Inc. smoke guard (A), with as little gap between the two fins at the center of the detector guard as possible, as illustrated in FIG. 6. The gap between the fins (B) under the center of the smoke detector head (C), shown in FIG. 6 should be no greater than one-sixteenth of an inch (1/16") for best performance.

Figure 7:
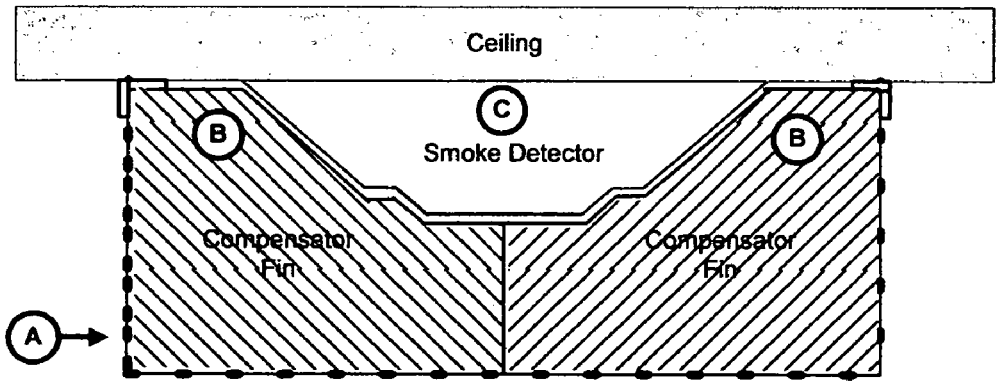
FIG. 7 shows a cross-section view of a ceiling-mounted Chase Security Systems, Inc. Model CSGP 884 SMOKE DETECTOR/STROBE/BELL GUARD (A) installed with a Smoke Detector Guard Compensator (B), over a smoke detector head (C) that has been Underwriter Laboratories, Inc. listed for use with the Chase Security Systems, Inc. smoke detector guard/compensator assembly.

FIG. 7 illustrates a cross-section of a ceiling-installed Chase Security Systems, Inc. smoke detector guard (A), with a Smoke Detector Guard Compensator (B), in an assembly with a smoke detector head (C) that has been Underwriter Laboratories, Inc. listed for use with this assembly. When the Chase Security Systems, Inc. smoke detector guard and compensator assembly is installed, the installer should first install the smoke detector head in compliance with pertinent code and the manufacturer's instructions, being careful to leave sufficient space around the smoke detector to accommodate the Chase Security Systems, Inc. smoke detector guard and compensator assembly. Secondly, the installer places the Chase Security Systems, Inc. smoke detector guard and compensator assembly (including the Chase Security Systems, Inc. smoke detector guard mounting collar) around the detector head, being careful not to deform the compensator or force the assembly over the smoke detector head, and marks the outline of the Chase Security Systems, Inc. smoke detector guard mounting collar on the installed surface. The installer then mounts the Chase Security Systems, Inc. smoke detector guard mounting collar to the surface within the marked outline and per the Chase Security Systems, Inc. instructions. The installer then attaches the Chase Security Systems, Inc. smoke detector guard and compensator to the Chase Security Systems, Inc. smoke detector guard mounting collar per the Chase Security Systems, Inc. mounting instructions. The actual mounting hardware in Chase Security Systems, Inc. smoke detector guard is not shown.

Figure 8:
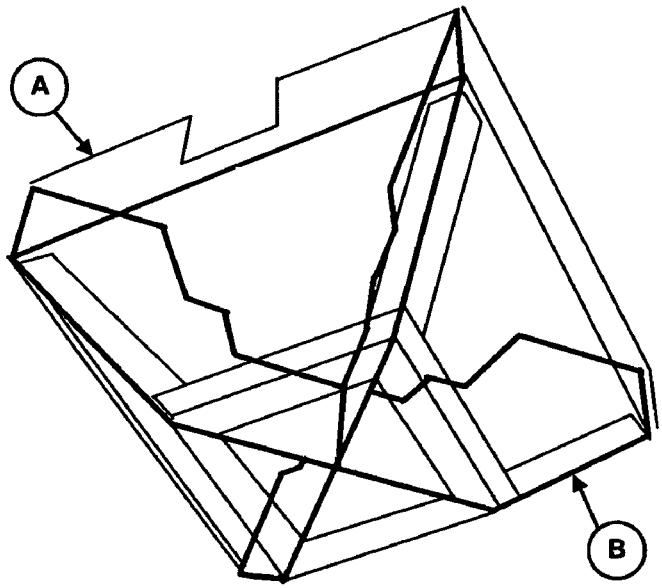
FIG. 8 shows an isometric view of the Smoke Detector Guard Compensator (B) in combination with a Chase Security Systems, Inc. sloped smoke detector guard (A), such as the Model CSSP 884 or Model CSSP 885. The perforated plate walls and attachment hardware of the Chase Security Systems, Inc. smoke detector guard are not shown for purposes of illustration.
Figure 9:
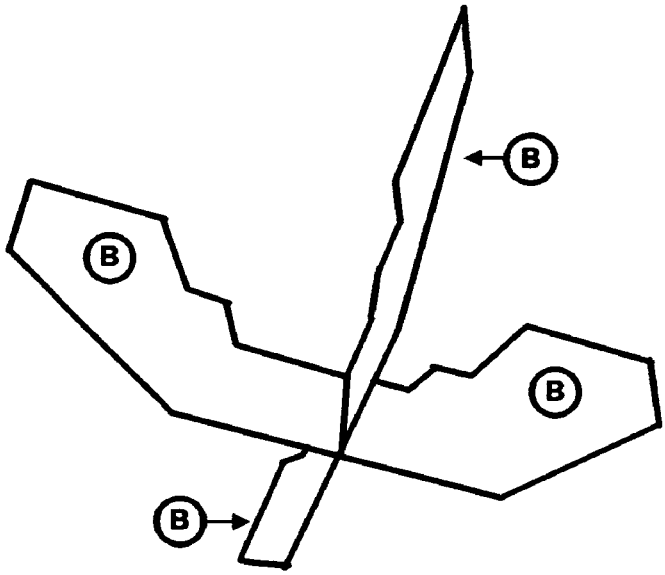
FIG. 9 shows the same isometric view of the Smoke Detector Guard Compensator (B). shown in FIG. 8, but without the Chase Security Systems, Inc. smoke detector guard (A).
Figure 10:
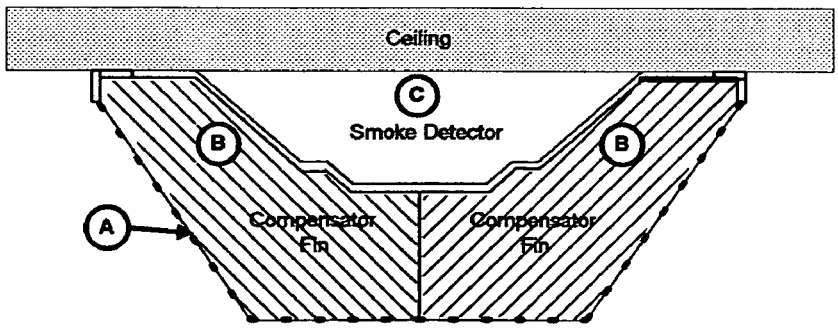
FIG. 10 shows a cross-section view of a ceiling-mounted Chase Security Systems, Inc. sloped smoked detector guard such as the Model CSSP 885 (A) installed with a Smoke Detector Guard Compensator (B), over a smoke detector head (C) that has been Underwriter Laboratories, Inc. listed for use with the Chase Security Systems, Inc. smoke detector guard/compensator assembly.

FIGS. 8, 9, and 10 illustrate how the fins of the Smoke Detector Guard Compensator (B) would be formed to fit into a non-rectangular shaped smoke detector guard (A) such as the Chase Security Systems, Inc. Model CSSP 884 or CSSP 885. Exact dimensions are not given since the dimensions of these two units vary. Chase Security Systems, Inc. mounting hardware and details are also not shown, consistent with the other drawings, since these are already features of the Chase Security Systems, Inc. products which are not part of this patent.

The intent of the above drawings is to illustrate the principle of the Compensator, and how the fins of the Compensator collect and direct the smoke entering the smoke detector guard to the smoke detector head located within the assembly.

The invention claimed is:

1. A baffle system consisting of thin solid fins, plates or blades that are installed, added, affixed, formed with, or otherwise constituted as part of guards that are fabricated to be installed over or around devices for the detection of the products of combustion in order to provide protection for said devices for the detection of products of combustion from physical damage and/or tampering, such that:

(a) the thin solid fins, plates or blades of the system are formed to fit and connect to the corners, sides, and other interior surfaces of said guard to within one eighth inch of the ceiling or wall surface to which said guard and said device for the detection of the products of combustion are attached, and to fit to within one eighth inch of the profile of an external cover or housing of the device for the detection of the products of combustion;

(b) the thin solid fins, plates, or blades of the system form a series of chambers within the space between the interior surface of said guard and the exterior surface of the cover or housing of the device for the detection of the products of combustion;

(c) wherein the chambers narrow from the interior surfaces of the corners, sides and/or bottoms of the guard to the exterior surfaces of the cover or housing of the device for the detection of the products of combustion;

(d) wherein the narrowing chambers direct and concentrate the atmosphere entering through openings in the in the surface of the guard to openings in the exterior cover or housing of the device for the detection of the products of combustion.

* * * * *